US010087061B2

(12) United States Patent
Meinzinger et al.

(10) Patent No.: US 10,087,061 B2
(45) **Date of Patent: *Oct. 2, 2018**

(54) SINGLE-USE EVACUATION SYSTEM FOR CONTAINERS

(71) Applicant: KRONES AG, Neutraubling (DE)

(72) Inventors: Rupert Meinzinger, Kirchroth (DE); Ute John-Unterburger, Suenching (DE)

(73) Assignee: KRONES AG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/021,922

(22) PCT Filed: Sep. 12, 2014

(86) PCT No.: PCT/EP2014/069554

§ 371 (c)(1),
(2) Date: Mar. 14, 2016

(87) PCT Pub. No.: WO2015/036573

PCT Pub. Date: Mar. 19, 2015

(65) Prior Publication Data

US 2016/0229674 A1 Aug. 11, 2016

(30) Foreign Application Priority Data

Sep. 13, 2013 (DE) ..... 10 2013 110 121

(51) Int. Cl.

| | |
|---|---|
| ***B65D 35/54*** | (2006.01) |
| ***B67D 1/00*** | (2006.01) |
| ***B67D 1/08*** | (2006.01) |

(52) U.S. Cl.

CPC ..... *B67D 1/0001* (2013.01); *B67D 1/0004* (2013.01); *B67D 1/0841* (2013.01); *B67D 1/0891* (2013.01)

(58) Field of Classification Search

CPC ..... B67D 1/0001; B67D 1/0004

(Continued)

(56) References Cited

U.S. PATENT DOCUMENTS 4,234,104 A * 11/1980 Apuzzo, Jr. ..... B65D 35/285 141/362
5,206,037 A * 4/1993 Robbins, III ..... B29C 53/08 264/295

(Continued)

FOREIGN PATENT DOCUMENTS

CN 103189304 7/2013 ..... B67D 1/111
CN 203845801 9/2014 ..... B67D 1/0001

(Continued)

OTHER PUBLICATIONS

International Search Report and Written Opinion (with translation) issued in application No. PCT/EP2014/069554 dated Nov. 28, 2014 (22 pgs).

(Continued)

*Primary Examiner* — Patrick M Buechner
*Assistant Examiner* — Michael J Melaragno
(74) *Attorney, Agent, or Firm* — Hayes Soloway P.C.

(57) ABSTRACT

An apparatus for extracting fluids from containers, with a first holding device suitable for holding a first region of the container, with a second holding device suitable for holding a second region of the container, and with a movement device which generates a relative movement of one holding device relative to the other holding device, in order thus to evacuate the container arranged at least in portions between these holding devices by its compression. At least one holding device is formed multi-piece with at least two components moveable relative to each other.

20 Claims, 4 Drawing Sheets

(58) Field of Classification Search
USPC ..... 222/96, 541.2
See application file for complete search history.

(56) References Cited

U.S. PATENT DOCUMENTS

| | | | | |
|---|---|---|---|---|
| 5,215,218 | A * | 6/1993 | Choi | B65D 35/285 141/355 |
| 5,505,336 | A * | 4/1996 | Montgomery | B67D 1/0001 222/326 |
| 5,553,740 | A | 9/1996 | King et al. | 222/1 |
| 5,775,533 | A * | 7/1998 | Schroeder | A23G 9/285 222/105 |
| 6,105,820 | A * | 8/2000 | McGill | A23G 9/28 222/146.6 |
| 6,131,766 | A * | 10/2000 | King | B67D 7/0227 222/1 |
| 8,528,783 | B2 * | 9/2013 | Pritchard | B65D 75/5877 222/541.2 |
| 9,221,666 | B2 | 12/2015 | Vandekerckhove et al. | B67D 1/0831 |
| 9,708,169 | B2 * | 7/2017 | Meinzinger | B67D 1/0001 |
| 2006/0054641 | A1 * | 3/2006 | Evers | B67D 1/0001 222/326 |
| 2007/0023453 | A1 * | 2/2007 | Simkins | A47K 5/122 222/183 |
| 2007/0138202 | A1 * | 6/2007 | Evers | A47J 47/01 222/95 |
| 2008/0187638 | A1 * | 8/2008 | Hansen | A47J 31/0673 426/433 |
| 2010/0213210 | A1 * | 8/2010 | Drennow | B67D 1/0001 222/82 |
| 2011/0110180 | A1 * | 5/2011 | Snider | A47J 31/407 366/142 |
| 2011/0220652 | A1 * | 9/2011 | Corbett | B65D 77/06 220/495.03 |
| 2012/0104020 | A1 * | 5/2012 | Cur | B67D 1/0001 222/1 |
| 2012/0168461 | A1 * | 7/2012 | Topits | B65D 47/0804 222/105 |
| 2012/0295215 | A1 * | 11/2012 | Jelovac | B05C 17/0103 433/25 |
| 2014/0034667 | A1 * | 2/2014 | Peirsman | B67D 1/0406 222/1 |
| 2015/0028052 | A1 * | 1/2015 | Rasmussen | B67D 1/0081 222/1 |
| 2015/0053716 | A1 | 2/2015 | Meinzinger et al. | 222/23 |
| 2015/0237884 | A1 * | 8/2015 | McGill | A23G 9/045 222/94 |
| 2015/0290598 | A1 * | 10/2015 | Van Damme | B67D 1/0462 261/64.1 |
| 2015/0315004 | A1 * | 11/2015 | Meinzinger | B67D 1/0001 222/95 |
| 2015/0344280 | A1 * | 12/2015 | Meinzinger | B67D 1/0829 222/82 |
| 2016/0214849 | A1 * | 7/2016 | Krueger | B67D 1/0001 |
| 2016/0229674 | A1 * | 8/2016 | Meinzinger | B67D 1/0001 |
| 2018/0134535 | A1 * | 5/2018 | John-Unterburger | B67B 7/24 |

FOREIGN PATENT DOCUMENTS

| | | | |
|---|---|---|---|
| DE | 4431427 | 2/1996 | B67D 7/02 |
| DE | 102007054431 | 5/2009 | B67D 3/00 |
| DE | 102012101503 | 8/2013 | B67D 3/00 |
| DE | 102012101507 | 8/2013 | B67D 3/00 |
| EP | 2067740 | 10/2009 | B67D 1/04 |
| WO | WO2012160036 | 11/2012 | B67D 1/08 |

OTHER PUBLICATIONS

International Preliminary Report on Patentability (no translation) issued in application No. PCT/EP2014/069554, dated Mar. 15, 2016 (8 pgs).
German Search Report (no translation) issued in application No. 10 2013 110 121.6, dated Jul. 8, 2014 (7 pgs).
Chinese Office Action issued in application No. 201310669489.7, dated Jan. 4, 2016 (6 pgs).
Chinese Office Action (w/translation) issued in application No. 201310669489.7, dated May 5, 2017 (11 pgs).
Chinese Office Action(w/translation) issued in application No. 201310669489.7, dated. Aug. 22, 2017 (4 pgs).

* cited by examiner

SINGLE-USE EVACUATION SYSTEM FOR CONTAINERS

BACKGROUND OF THE INVENTION

The present invention relates to an evacuation system or extraction system for containers. Various extraction systems are known from the prior art. For example, it has been known for some time to pressurize the containers, and in this way the filling can be extracted from the containers. However, devices are also known from the prior art which achieve the extraction of the fluid from the container by crushing the container. In an apparatus known from the prior art, two holding devices are provided which hold two different components of the containers and can be moved towards each other.

The prior art also discloses various extraction systems which for example have tap cocks and similar. In particular, the multiple use systems known in the prior art do not guarantee a pure beverage, for example pure beer, with tapping, unless the corresponding components are cleaned regularly.

Hence in these cases it would be desirable to be able to use single-use systems at least partially, for example single-use tap lines and similar.

The present invention is therefore based on the object of providing such an extraction device for containers which allows the use of at least some single-use parts.

SUMMARY OF THE INVENTION

An apparatus according to the invention for extracting fluids from containers has a first holding device which is suitable for holding a first region of the container. The apparatus also has a second holding device which is suitable for holding a second region of the container (which in particular is spaced from the first region of the container) and a movement device which generates a relative movement of one holding device relative to the other holding device is compressed, so that the container arranged at least in portions between these holding devices and in this way the filling can be extracted from the container.

According to the invention, at least one holding device is formed in several pieces with at least two components moveable relative to each other.

Whereas, in the prior art, such holding devices are usually formed of one piece, it is proposed as part of the invention to provide a multi-piece configuration in order to allow easier integration of single-use parts thanks to this multi-piece configuration. Said parts can then be exchanged relatively easily, for example when changing a beverage container.

The holding device may for example be a die which can be advanced towards a second holding device in order to compress the container in-between as completely as possible. As part of the invention therefore, the use of a two-piece or multi-piece die is proposed. Advantageously, the holding devices are arranged such that the container lying in-between is compressed in the longitudinal direction of this container.

Furthermore, advantageously, a drive device is proposed which causes the relative movements of the two holding devices relative to each other. This may for example be a spindle drive, the adjustment of which moves the holding devices relative to each other. Furthermore it is possible that one of the two holding devices is arranged stationarily and the other holding device moves relative to this. The multi-piece holding device is advantageously arranged stationarily in a working mode, i.e. for an extraction process, the other holding device is advanced towards this holding device.

In a further advantageous embodiment, the holding device has a receiving region which serves to receive an extraction means for extracting the fluid, wherein this receiving region is made accessible by the relative movement of the components moveable relative to each other.

This receiving region may have supporting means for arranging the extraction means in a (precisely) defined position relative to the holding device. Thus for example a tapping means may be inserted in this receiving region. Preferably, for use of such a tapping means, the holding device is opened by the components being moved relative to each other, for example moved into an opening position so that then the extraction means can be inserted.

It would for example be conceivable that the holding device has two half shells which can be folded apart in order to insert the extraction means in the opened receiving region. It would however also be conceivable that the receiving region can be made accessible via a door or similar. Advantageously, in working mode the receiving region is completely surrounded in a peripheral direction by the other portions of the holding device.

In a further advantageous embodiment, the holding means formed in several pieces is suitable for receiving a mouth region of the container. Thus it is possible for example that the holding means is adapted to a container from which fluid is to be extracted in the form of a shoulder region. A receiving region or receiving recess may be provided which serves to receive the mouth of the container.

In a further advantageous embodiment, the device has an extraction means for extracting the fluid from the container. This extraction means is preferably an element which can be removed from the holding device.

Advantageously, the extraction means is a single-use extraction means. This may be configured so that after a use, it can no longer be reused and in particular no longer be used for further containers.

In a further advantageous embodiment, the extraction means and/or the holding device have a catch mechanism and/or a snap mechanism which, under a defined force loading, transforms into a state in which the extraction means can no longer be used for further containers or for their extraction. Advantageously, the force loading is a force which is exerted by a movement of the container relative to the holding device. This catch mechanism is a mechanism in which at least one portion of the extraction means cooperates with at least one portion of the holding device. Particularly preferably, the extraction means engages with part of the container from which fluid is to be taken, for example with a closure of the container.

In a further advantageous embodiment, the components of the holding device which are moveable relative to each other are pivotable relative to each other about a predefined pivot axis. Thus it would be possible, as already stated, for the holding device to have two halves which can be folded apart. It would however also be possible for a smaller part to be pivotable relative to a larger part. Advantageously, this is an axis which runs parallel to or perpendicular to a longitudinal direction of the container to be compressed.

Advantageously, in other words, this is a pivot axis which also runs in the movement direction in which the holding devices are advanced towards to each other. It would however also be possible for an opening to be made by a slide movement, for example a drawer-like movement. Thus the openable die mentioned here contains an apparatus which preferably has a type of release mechanism. This mechanism, which may for example be a slider, can be moved in a predefined direction, for example upwards, on insertion of a container, in particular a plastic container, and in this process a snap device or catch device may be triggered which guarantees a single use of the extraction device.

This catch means or snap closure on the single-use connection forces the user to also change the associated single-use line, thus leading to a type of guaranteed exchange also of the respective extraction lines. In this way, also the entire system can be viewed as a single-use system, since the container with its closure and also the lines such as single-use lines must be exchanged or removed on completion of a tapping process. However, on the other hand it is not absolutely essential to compress the container completely, but it may be ensured that a container which is still half-full or half-empty, after opening of the holding device, cannot be compressed further. In this way, a fully hygienic tapping process is achieved.

The above-mentioned catch mechanism may be formed by the extraction means itself; it is however also possible that the catch mechanism results from a cooperation between the holding device and the extraction means.

Advantageously, during a tapping process, the extraction means is arranged by force fit in the receiving region. Advantageously, the extraction means has a line for conducting the beverage to be extracted, in particular a so-called tap line.

In a further advantageous embodiment, the extraction means has a puncture means which is suitable for puncturing a region of the container. This is advantageously the region of a closure of the container. This puncture means may advantageously be designed as a peripheral needle which can firstly be introduced into the container through the container closure, but which secondly functions as a conduction piece through which the beverage can be transported. In a further advantageous embodiment, this puncture means is arranged slidably relative to a carrier of the extraction means. This sliding process may also trigger the catch mechanism, so that for example on first puncture, the puncture means is moved into a position in which it is no longer suitable for a further extraction of fluid from a further container.

The present invention is furthermore oriented at an extraction means for extracting fluid from containers. This extraction means has a carrier and a puncture means arranged on this carrier which is provided for puncturing a region of the container, and a conduction device which is suitable for conducting fluids. According to the invention, the extraction means is formed as a single-use extraction means and has a catch mechanism which causes the extraction means, in a state used in an apparatus for extracting fluids, to be usable only for extracting fluid from precisely one container.

Advantageously, the puncture means is displaceable relative to the carrier and in particular slidably in a straight direction. Particularly preferably, this sliding triggers and/or actuates the catch mechanism. Preferably, a sliding of the puncture means relative to the carrier causes locking of the puncture means.

BRIEF DESCRIPTION OF THE DRAWINGS

Further advantages and embodiments result from the enclosed drawings which show.

DETAILED DESCRIPTION OF THE INVENTION

Figure 1:
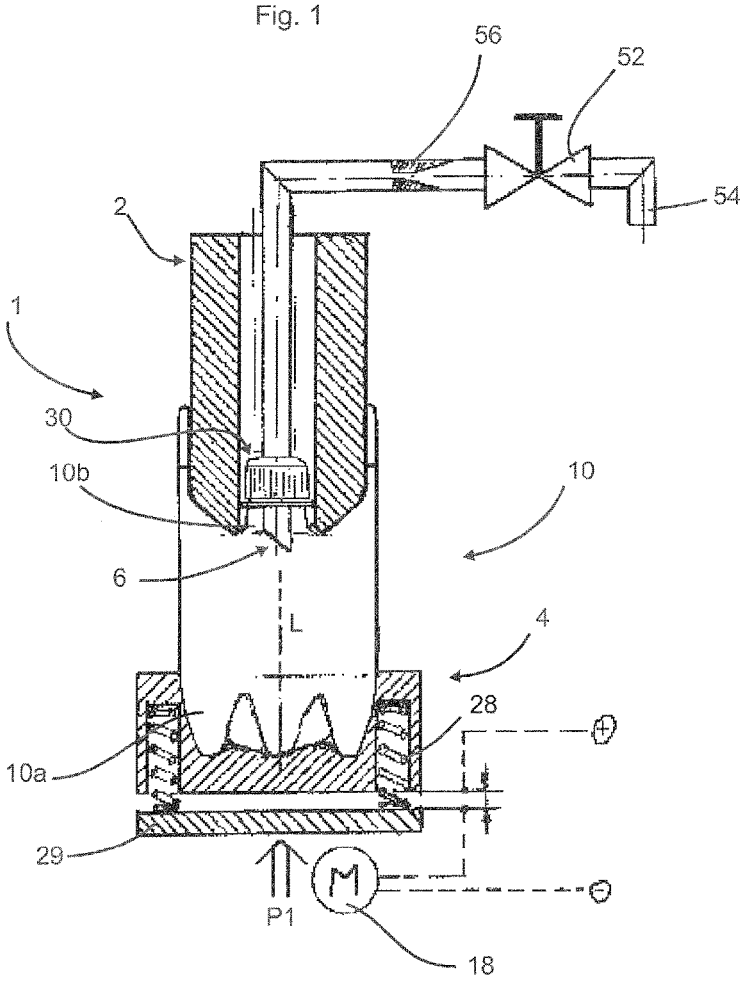
FIG. 1 a diagrammatic view of an apparatus according to the invention for extracting fluids from containers.

FIG. 1 shows an apparatus 1 for extraction of fluids from a container 10. This apparatus 1 has a first holding device 2 which receives a first region 10*b* of the container 10, here a mouth region of the container 10, and a second holding device 4 which receives a second region 10*a* of the container, here a floor region of the container.

By means of a drive device such as a motor 18, this holding device 4 may be moved upward, wherein the container 10 arranged between these two holding devices is thereby compressed and thus the fluid can be extracted therefrom. Advantageously, a contour of the holding device 4 facing towards the container 10 is adapted at least in regions to a corresponding contour of the first holding device 2, so that the container between these two holding devices can be compressed to a very narrow space in order to be able to extract as much fluid as possible. Reference numeral 29 designates a carrier on which the holding device 4 is mounted via a pretension device 28 such as a spring.

A choke device 56 may be arranged in an extraction line for extracting fluid. Reference numeral 52 designates a valve device which can be opened to extract the fluid via an outlet 54.

Figure 2:
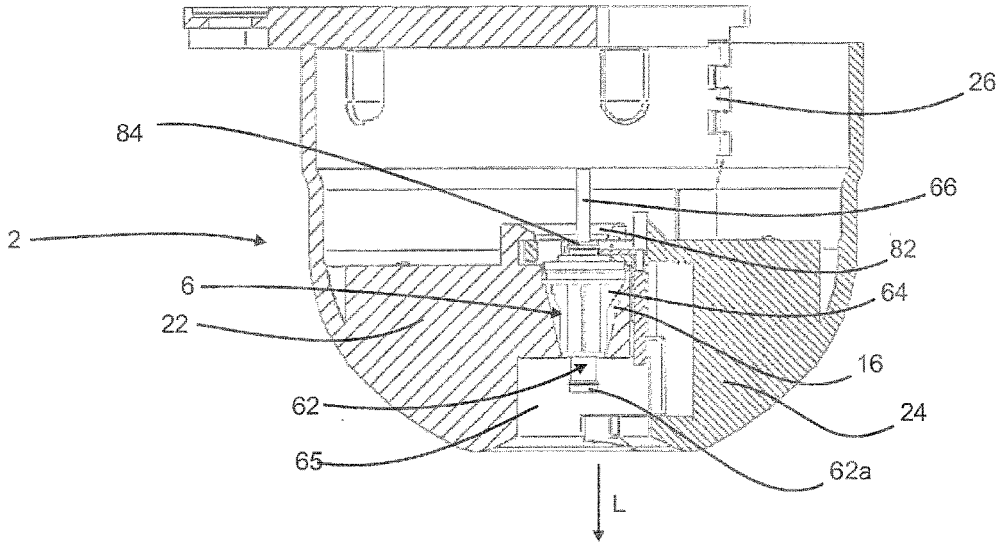
FIG. 2 a view of a first holding device 2.

FIG. 2 shows a view of a first holding device 2 which receives the upper region of the plastic container 10 to be extracted (see FIG. 1). This holding device 2 is formed in two pieces and has a first component 22 and a second component 24. The component 24 can be pivoted relative to the first component 22 by means of a pivot device such as a hinge 26, around a geometric axis running vertically here.

The holding device 2, as shown, furthermore comprises in closed state a receiving region 16 in its interior in which an extraction means, designated as a whole as 6, is arranged. This extraction means 6 has a puncture means 62, here formed as a tubular body, and in its lower region a cutting element 62*a* which for example can puncture the cover of a container. Reference symbol L designates a longitudinal direction in which the container to be compressed extends. Reference numeral 65 designates a receiving space which serves to receive a container closure (not shown) during the compression process.

Reference numeral 64 relates to a base body of the extraction device, on which the puncture means 62 is arranged displaceably in the longitudinal direction L.

Reference numeral 66 designates an extraction line which is here arranged in particular fixedly on the extraction means 6. The puncture means 62 is moveable relative to the carrier 64 and hence also relative to components 22 and 24 in the longitudinal direction L.

Reference numerals 82 and 84 designate a catch mechanism which serves to ensure, on puncture or on further movement of the second holding device into the container, that the extraction means 6 cannot be used a second time for a further container. When the container from which fluid to be extracted is lifted, a first catch means 82 is forced up and engages behind a second catch means. This has the consequences that the puncture means is pushed upward and is no longer able to puncture a further container.

The base body of the components 22 and 24 is configured such that it can adapt to a shoulder of the container, and in this way an almost complete extraction of fluid from the container is possible.

Figure 3:
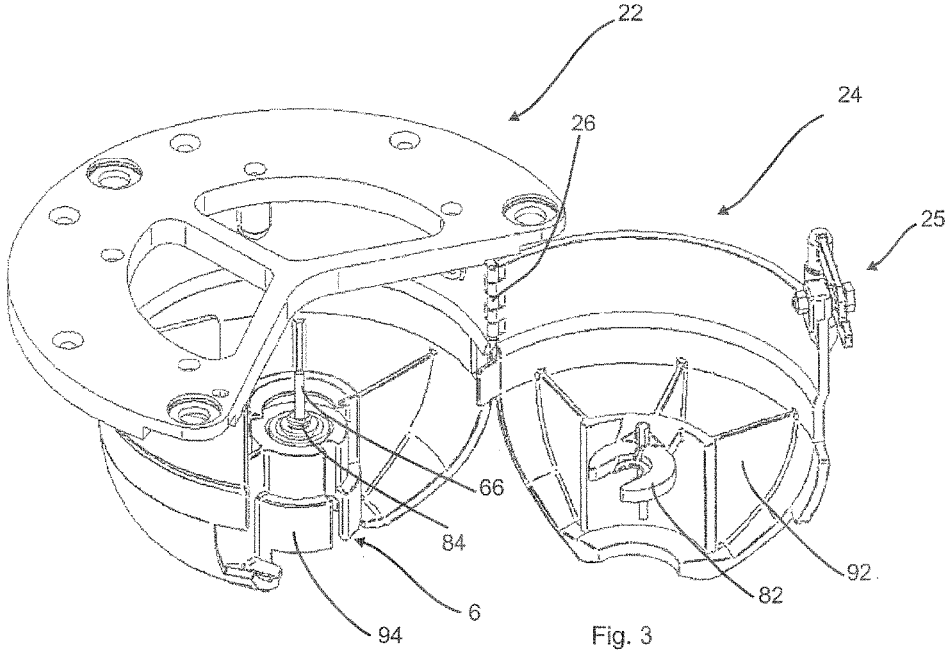
FIG. 3 the holding device from FIG. 2 in open state.

FIG. 3 shows the first holding device in the state pivoted open, i.e. a state in which the second component 24 is folded out relative to the first component 22. It is evident here that support elements 92 are arranged inside the two components 22 and 24 to increase their stability.

It is further evident that a catch element 82 is here arranged on the component 24, and the second catch element 84 is arranged on the extraction means 6. A holder 94 for the extraction means can also be seen.

In the open state shown in FIG. 3, the extraction means can easily be inserted in or removed from the apparatus. Engagement means may also be provided on the extraction means and/or the holding device, which allow the extraction means to be inserted in the holding device 2 or receiving region 16 only at a position provided precisely for this. Preferably, it is possible to insert the extraction means in the receiving region 6 without tools, and/or remove the extraction means from the receiving region without tools.

Figure 4:
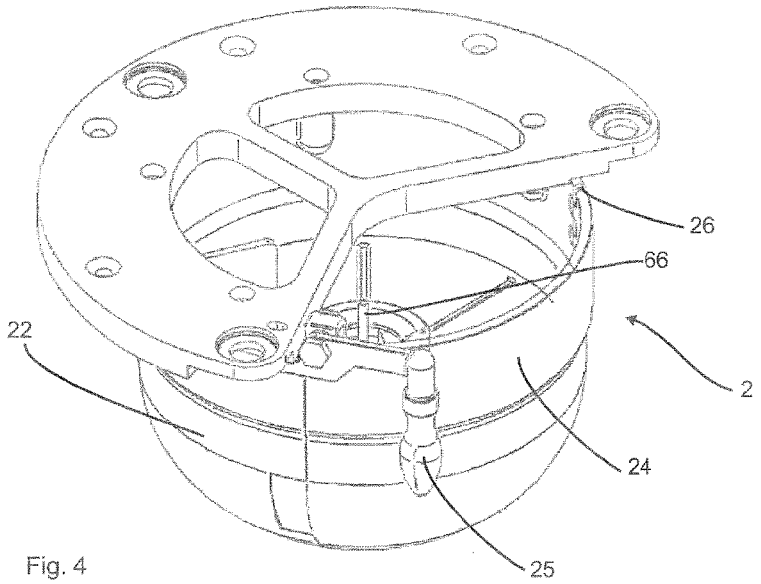
FIG. 4 the holding device from FIG. 2 in closed state.

FIG. 4 shows a further view of a holding device 2, now closed. Here a locking element 25 can be seen which here can be pivoted about a (horizontal) axis in order to allow an opening of the holding device. In installation state, this locking element 25 is easily accessible for the user even if he can only reach the holding device 2 from one side.

Figure 5:
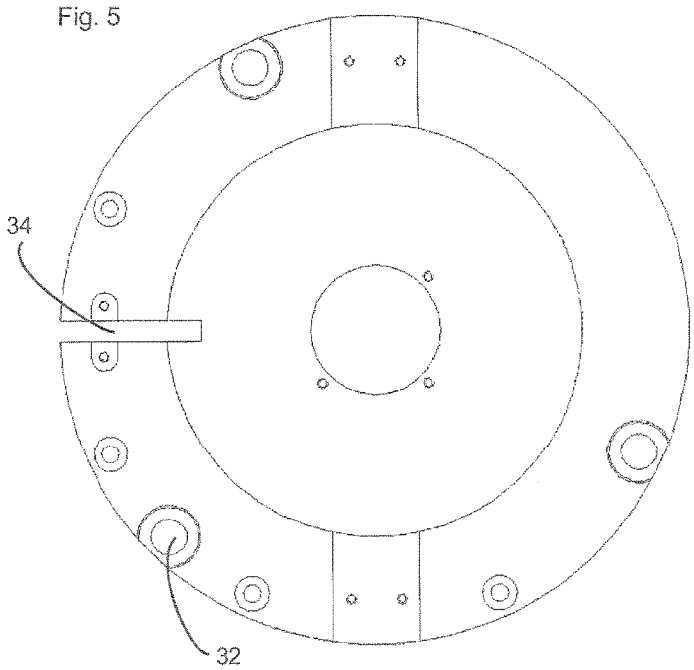
FIG. 5 a view from below onto the holding device in FIG. 2.

FIG. 5 shows a further depiction of a further embodiment of the invention in a view from below. The fixing means 32 visible in the other figures is also evident here, by means of which the holding device 2 can be mounted e.g. bolted to a frame of the apparatus. Reference numeral 34 identifies a groove or recess via which for example a tap line can be guided.

Figure 6:
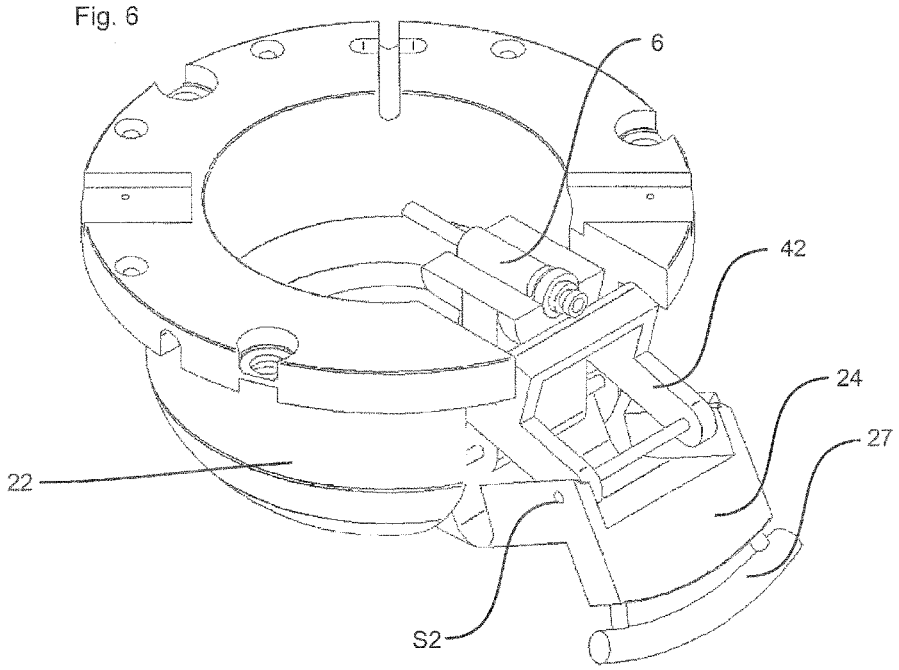
FIG. 6 a further embodiment of a holding device.

FIG. 6 shows a further depiction of the apparatus shown in FIG. 5 in a perspective view. Here it can be seen that the second component 24 is also pivoted about an axis relative to the first component 22, here however about a substantially horizontal axis. This means that, in operation, the user can remove the extraction means 6 here after he has folded the component 24 open about a horizontal axis. Reference numeral 27 designates a handle.

Figure 7:
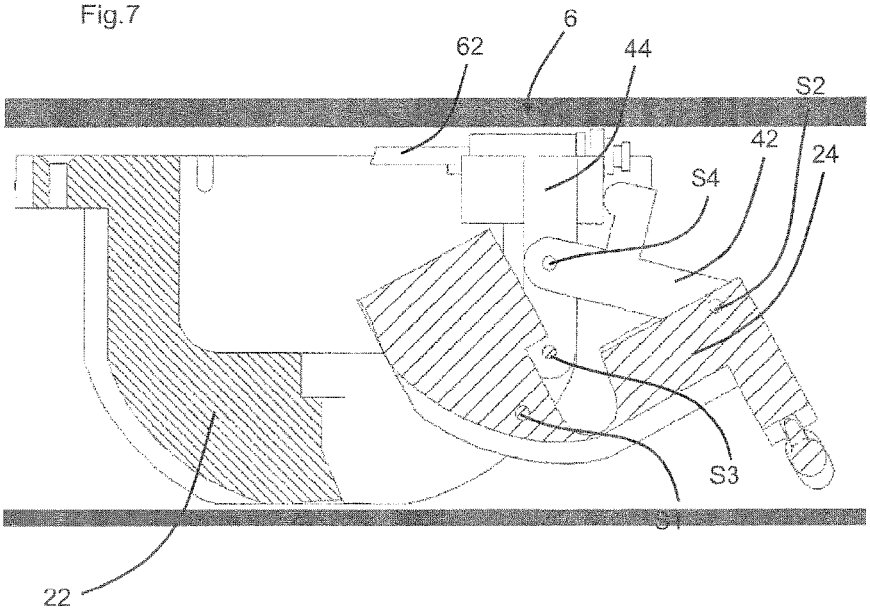
FIG. 7 a side view of the holding device from FIG. 6.

FIG. 7 shows a side view of the device shown in FIG. 6. Here we can see that the component 24 as a whole can be pivoted about a first pivot axis S1. This pivot movement furthermore causes, via the two linkage bodies 42 and 44, the extraction means 6 or an insert for this extraction means 6 to be tilted from the horizontal position shown in FIG. 7 to a vertical position. More precisely, the first linkage body is arranged pivotably relative to a pivot axis S2 on a region of the component 24, and the second linkage body 44 is also arranged pivotably relative to a pivot axis S3 on the first component.

Advantageously, in the embodiment shown in FIG. 7, an insert device is provided for inserting the extraction means 6, wherein the insert device has a first linkage body 42 pivotable relative to a first predefined pivot axis, and a second linkage body 44 pivotable relative to a second pivot axis S2, which preferably are also coupled together pivotably relative to a further pivot axis S4. Advantageously, at least two of said pivot axes S1 to S4 run parallel to each other, advantageously at least three, and more advantageously four. If only two or three pivot axes are parallel to each other, arbitrary pivot axes may be parallel to each other, such as S1 and S2 or S2, S3 and S4.

Preferably, a pivot movement of the extraction means 6 and/or the receiving region for the extraction means 6 is coupled to a pivot movement of the component 22 of the holding device 2.

Also in the embodiment shown in FIG. 7, for example the extraction means 6 may be inserted from above and folded into its end position. In the apparatus shown in FIG. 7 however, on extraction or insertion of the extraction means 6, preferably exclusively a movement thereof takes place in just one plane, namely a plane which coincides with the figure plane in FIG. 7 and which preferably also contains a longitudinal direction of the container to be compressed. This is particularly suitable since it is possible to exchange the extraction element even with little space available. Preferably, the extraction element is exchanged by means of a pivot movement of the extraction means.

A further advantageous embodiment of the extraction means (not shown) is configured such that catch means are provided on the extraction means, which can engage on a closure of a container. Advantageously, these catch means are formed as claws which are arranged symmetrically around the puncture means. During the advance movement between the holding device and the container, these claws engage on corresponding catch points arranged on the closure of the container.

The applicant reserves the right to claim all features disclosed in the application documents as essential to the invention where novel individually or in combination relative to the prior art.

LIST OF REFERENCE NUMERALS

1 Apparatus
2 Holding device
6 Extraction means
10 Container
10*a* Floor region of container 10
10*b* Mouth region of container 10
16 Receiving region
18 Drive device
22 First component
24 Second component
25 Locking element
26 Hinge
27 Handle
28 Pretension device
29 Carrier
30 Closure of container
32 Fixing means
34 Groove/recess
42, 44 Linkage body
52 Valve device
54 Outlet
56 Choke device
62 Puncture means
62*a* Cutting element
64 Base body/carrier
65 Receiving space
66 Extraction line
82, 84 Catch mechanism
92 Support elements
94 Holder
L Longitudinal direction
S1 First pivot axis
S2 Second pivot axis
S3 Third pivot axis
S4 Fourth pivot axis

The invention claimed is:

1. An apparatus for extracting fluids from containers, said apparatus comprising:

a first holding device adapted for holding a first region of the container, with a second holding device adapted for holding a second region of the container, and a mechanism for creating a relative movement of one holding device relative to the other holding device along a first predefined axis, in order thus to compress the container between the first and second holding devices, wherein at least one holding device comprises a multi-piece construction in which at least two components of said multi-piece construction are rotatably moveable relative to each other with respect to a second predefined axis parallel to the first predefined axis; and an extraction device for extracting the fluid from the container, wherein the extraction device and/or the holding device has a catch mechanism which, under a predefined force loading, engages the extractor so that the extractor cannot be used for further containers.

2. The apparatus according to claim 1, wherein the holding device having a multi-piece construction has a receiving region which serves to receive the extraction device for extracting the fluid, wherein this receiving region is made accessible by a relative movement of the components moveable relative to each other.

3. The apparatus according to claim 1, wherein the multi-piece holding device is adapted for receiving a mouth region of the container.

4. The apparatus according to claim 1, wherein the extraction device is a single-use extractor.

5. The apparatus according to claim 4, wherein the extraction device comprises a puncturer which is suitable for puncturing a region of the container.

6. The apparatus according to claim 5, wherein the puncturer is arranged displaceably relative to a carrier of the extractor.

7. A fluid extraction device for extracting fluids from containers, said fluid extraction device comprising:

a carrier, a puncturer arranged on the carrier and adapted for puncturing a region of the container, and a conduit communicating with the puncturer and adapted for conducting fluids from the container, wherein the puncturer is arranged with a catch mechanism on the carrier which catch mechanism is adapted to prevent the puncturer from being used to extract fluid from more than one container.

8. The apparatus according to claim 1, wherein the first holding device and/or the second holding device are adapted to directly contact the container.

9. The apparatus according to claim 1, wherein the one holding device carries a die which is adapted to be advanced towards the second holding device in order to enhance extraction of fluid from the container.

10. The apparatus according to claim 1, wherein the one holding device comprising a multi-piece construction is arranged stationary in a working mode, while the other holding device is advanced towards the multi-piece holding device.

11. The apparatus according to claim 4, wherein the at least one holding device comprises two half shells which are adapted to be folded apart in order to insert the single-use extraction element in an opened receiving region.

12. The apparatus according to claim 1, wherein the rotation axis is parallel to or perpendicular to a longitudinal direction of the container to be evacuated.

13. The apparatus according to claim 1, wherein the rotation axis runs in a movement direction in which the first and second holding devices are advanced towards one another.

14. An apparatus for extracting fluids from containers, said apparatus comprising:

a first device adapted for holding a first region of the container, with a second holding device adapted for holding a second region of the container, and a mechanism for creating a relative movement of one holding device relative to the other holding device, in order thus to compress the container between the first and second holding devices, wherein at least one holding device comprises a multi-piece construction in which at least two components of said multi-piece construction are moveable relative to each other; and a fluid extraction means including a single-use extractor for extracting fluid from the container, wherein the holding device includes a catch mechanism which engages the extractor and prevents the single-use extractor from being used a second time, and wherein a puncturer is arranged displaceably relative to a corner of the extraction means.

15. An apparatus for extracting fluids from containers, said apparatus comprising:

a first holding device adapted for holding a first region of the container, with a second holding device adapted for holding a second region of the container, and a mechanism for creating a relative movement of one holding device relative to the other holding device, in order thus to compress the container between the first and second holding devices, wherein at least one of said first and said second holding devices comprises a multi-piece construction in which at least two components of said multi-piece construction are moveable relative to each other, and a fluid extractor which includes a puncturer for puncturing the container, wherein one of said first and said second holding devices includes a catch mechanism which engages the puncturer to prevent the puncturer from being used a second time.

16. An apparatus for extracting fluids from containers, said apparatus comprising:

a first holding device adapted for holding a first region of the container, with a second holding device adapted for holding a second region of the container, and a mechanism for creating a relative movement of one holding device relative to the other holding device along a first predefined axis, in order thus to compress the container between the first and second holding devices, wherein at least one holding device comprises a multi-piece construction in which at least two components of said multi-piece construction are rotatably moveable relative to each other with respect to a second predefined axis parallel to the first predefined axis; and an extraction device for extracting the fluid from the container, wherein the extraction device is a single use extractor, and comprises a puncturer which is axially displaceable relative to a carrier of the extract, and is suitable for puncturing a region of the container.

17. The apparatus according to claim 16, wherein the holding device having a multi-piece construction has a receiving region which serves to receive the extraction device for extracting the fluid, wherein this receiving region is made accessible by a relative movement of the components moveable relative to each other.

18. The apparatus according to claim 16, wherein the multi-piece holding device is adapted for receiving a mouth region of the container.

19. The apparatus according to claim 16, wherein the one holding device carries a die which is adapted to be advanced towards the second holding device in order to enhance extraction of fluid from the container.

20. The apparatus according to claim 16, wherein the at least one holding device comprises two half shells which are adapted to be folded apart in order to insert the single-use extraction element in an opened receiving region.

* * * * *